United States Patent [19]

Shaw et al.

[11] 4,385,543

[45] May 31, 1983

[54] ADJUSTABLE BRIDGE FOR A STRINGED MUSICAL INSTRUMENT

[75] Inventors: Timothy Shaw; Charles T. Burge, both of Kalamazoo, Mich.

[73] Assignee: Norlin Industries, Inc., White Plains, N.Y.

[21] Appl. No.: 276,424

[22] Filed: Jun. 22, 1981

[51] Int. Cl.[3] ..... G10D 3/04

[52] U.S. Cl. ..... 84/298; 84/307

[58] Field of Search ..... 84/298, 299, 307, 314

[56] References Cited

U.S. PATENT DOCUMENTS

| | | | |
|---|---|---|---|
| 1,571,118 | 1/1926 | Hattie | 84/314 N |
| 2,905,042 | 9/1959 | Hoyer | 84/307 |
| 3,971,286 | 7/1976 | Borell | 84/298 |
| 4,128,033 | 12/1978 | Petillo | 84/299 |
| 4,160,401 | 7/1979 | Tomioka | 84/307 X |
| 4,248,126 | 2/1981 | Lieber | 84/299 |

FOREIGN PATENT DOCUMENTS

| | | | |
|---|---|---|---|
| 452570 | 8/1936 | United Kingdom | 84/299 |

*Primary Examiner*—Lawrence R. Franklin

*Attorney, Agent, or Firm*—Ronald J. Kransdorf

[57] ABSTRACT

An adjustable bridge for a stringed musical instrument which bridge has a bridge saddle mounting member and adjusts string height by providing a means for wedging this member up or down. Means are also provided for moving this member forward and backward to adjust intonation and to adjust the spacing between adjacent strings.

12 Claims, 6 Drawing Figures

ADJUSTABLE BRIDGE FOR A STRINGED MUSICAL INSTRUMENT

BACKGROUND OF THE INVENTION

This invention relates to a bridge for a stringed musical instrument and more particularly to an adjustable bridge for use with a fretted stringed instrument such as a guitar or bass guitar.

In a fretted stringed musical instrument such as a guitar or bass guitar, proper string height adjustment is critical to the operation of the instrument. If the string height is too low, particularly relative to the instrument fingerboard, an undesirable buzz sound will occur when the instrument is played, resulting from spurious contact of the strings with one or more frets; while if the string height is too high, the musician must apply excessive pressure to the strings, making the instrument difficult and uncomfortable to play. Such instruments will normally be factory adjusted for proper string height; however changes in temperature or humidity may effect subtle changes in the body or neck of the instrument necessitating an adjustment in the height of one or more strings. Changing the string gauge or type of string used on the instrument may also require a change in string height, or a musician may decide that changes in string height are necessary or desirable for other reasons.

In addition to changing string height, it may also be necessary, as a result of the factors indicated above or otherwise, to change the intonation of one or more strings of the instrument by adjusting the point on the string at which the string contacts the bridge saddle and the musician may also wish to vary the spacing between strings.

Prior art bridges have provided various means for performing one or more of the adjustments indicated above. However, in performing the string height adjustment, these bridges have generally relied on one of two methods. Perhaps the most common approach is to mount the bridge or bridge saddle assembly on the instrument body by use of a screw at either end with a thumb nut or similar element being provided on each screw to permit raising or lowering of the entire bridge. This approach has a number of drawbacks. First, this technique is only operative for raising or lowering all of the strings and it not adapted to individually adjust the height of each string. Second, it is sometimes difficult to uniformly adjust the screws resulting in uneven string height and other potential problems. But perhaps the most serious deficiency is the fact that the only contact between the bridge and the instrument body is through the two screws. This significantly weakens the ability of the instrument to transmit string vibrations to the instrument body and therefore adversely effects the sustain characteristics of the instrument. Ideally, there should be solid metal contact all the way from the bridge saddle to the instrument body.

The second approach to string height adjustment overcomes some of the problems indicated above by providing a screw adjustment for each individual bridge saddle. However, physical contact between the bridge saddle assembly and the bridge base and thus the instrument body is still made only through a single point at the end of a screw resulting in little mass at the adjustment point. As with the previous approach, this adversely effects the sustain characteristics of the instrument.

BRIEF SUMMARY OF THE INVENTION

The bridge of this invention overcomes the problems indicated above and provides maximum adjustment versatility as well as maximum mass at the adjustment point for good sustain characteristics. This is accomplished by providing a bridge base, a bridge saddle for each string of the instrument, a means for mounting each of the bridge saddles in a manner such that it may be independently moved up and down relative to the bridge base, and means for controlling the height of each of the bridge saddles by wedging the corresponding mounting means. The wedging of the mounting means is accomplished by a wedge member mounted between each of the mounting means and the bridge base, and by a means for independently moving each wedge member forward and backward relative to the corresponding mounting means to cause the mounting means, and thus the bridge saddle, to be raised or lowered. The bridge also includes a means for independently moving each bridge assembly, which assembly includes the bridge saddle, saddle mounting means, and the means for controlling the height of the saddle, in a forward and backward direction to independently control the intonation of each string. Finally, the bridge provides a mechanism for individually adjusting the spacing between adjacent strings. This is accomplished by forming each bridge saddle as a circular nut having a string receiving ridge form in its periphery and including a screw mounted perpendicular to the corresponding string in each saddle mounting means. The bridge saddle nut is mounted to rotate on the screw to adjust string spacing.

The foregoing and other objects, features and advantages of the invention will be apparent from the following more particular description of the invention.

DETAILED DESCRIPTION

Figure 1:
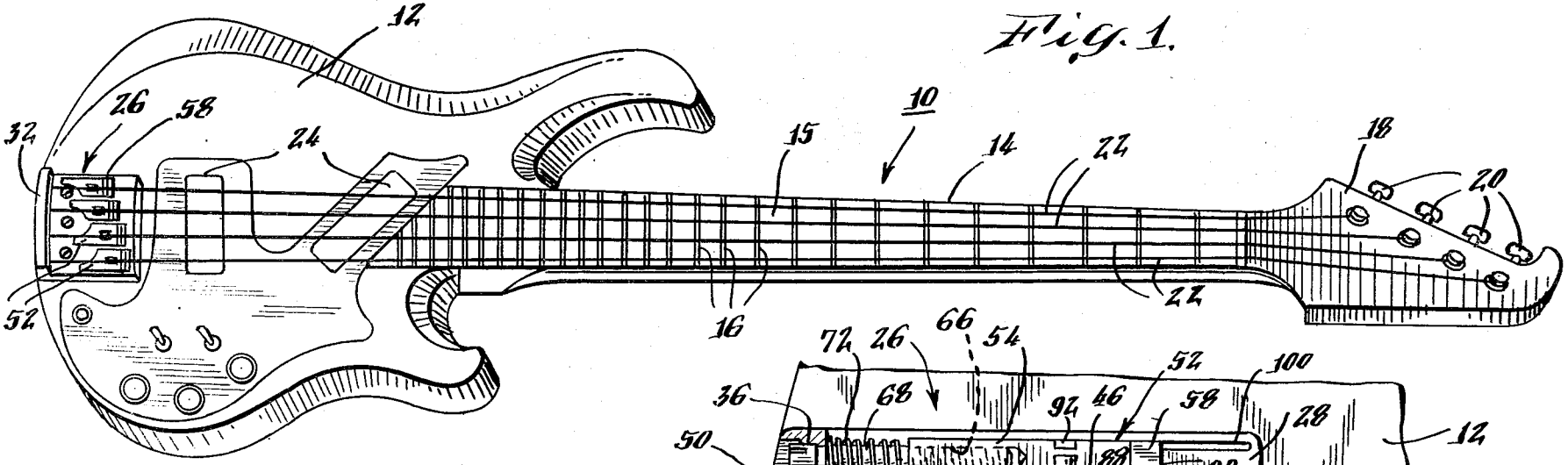
FIG. 1 is a prospective view of a bass guitar utilizing the bridge of this invention.

FIG. 1 illustrates a four string electric bass guitar 10 on which the bridge of this invention is being utilized. The guitar includes a body 12 having a neck 14 fixed to and extending from one end thereof. A fingerboard 15 having a plurality of frets 16 fixed therein is mounted over neck 14 and a portion of body 12. A peghead 18 is formed at the far end of neck 14, four machine heads 20 being mounted in peghead 18. Guitar strings 22 are fixed at one end to machine heads 20 and pass over frets 16 of fingerboard 15, over electric pick-ups 24 and terminate at their far end in combined bridge and tail piece assembly 26.

Figure 2:
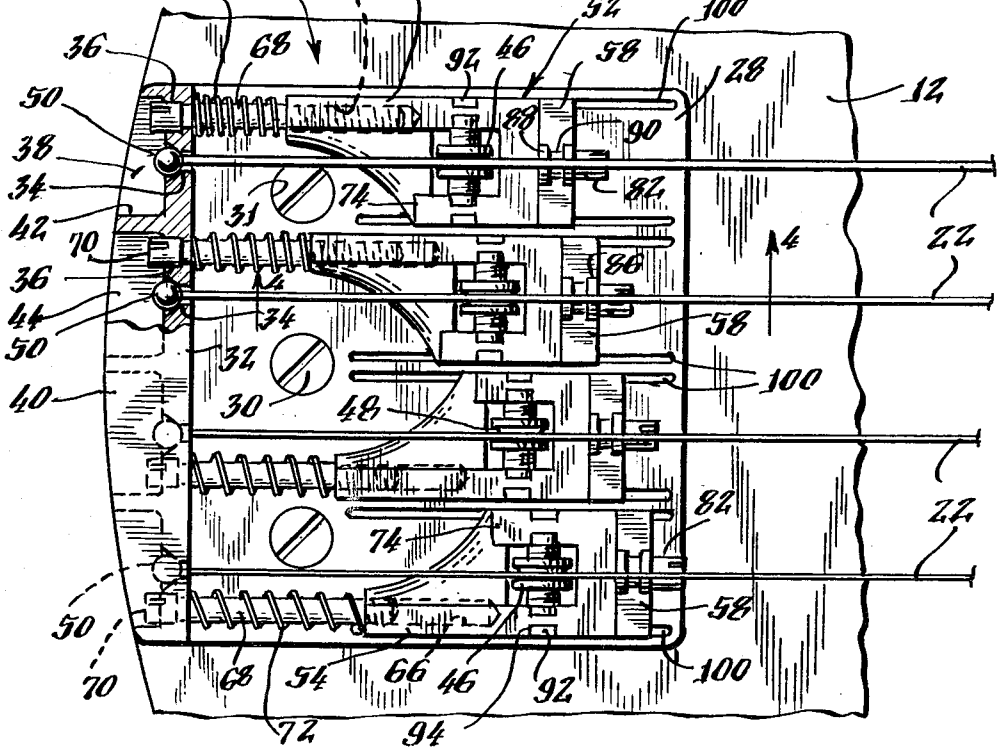
FIG. 2 is a top view, partially cut away, of the bridge of a preferred embodiment of this invention shown mounted on a bass guitar body.
Figure 3:
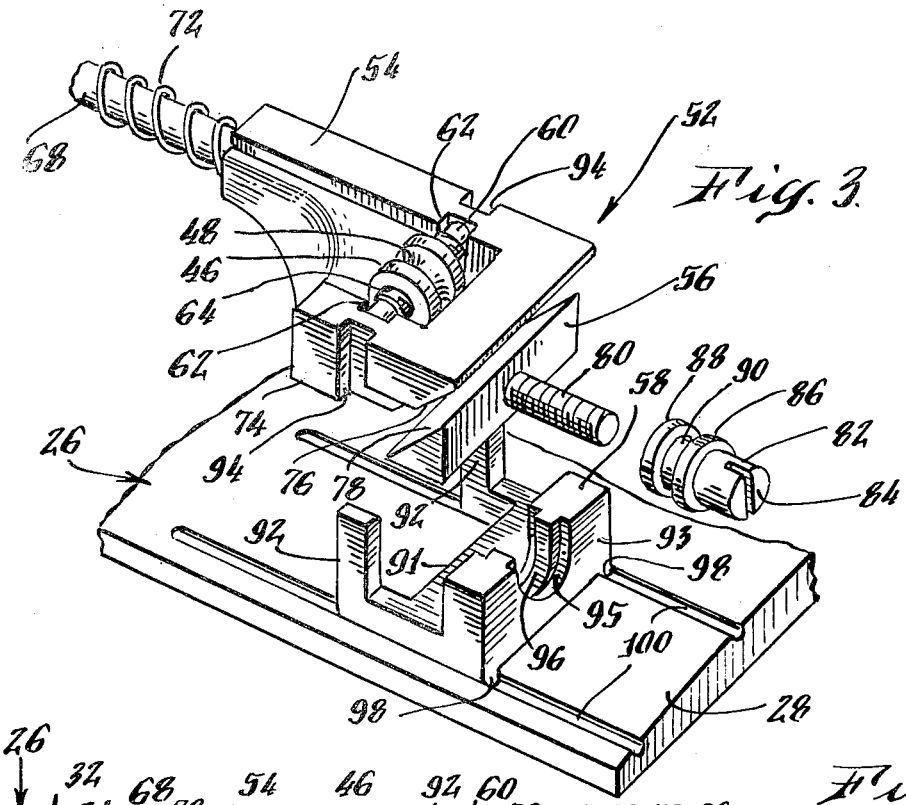
FIG. 3 is a partially exploded prospective view of a single bridge assembly for a preferred embodiment of this invention.
Figure 4A:
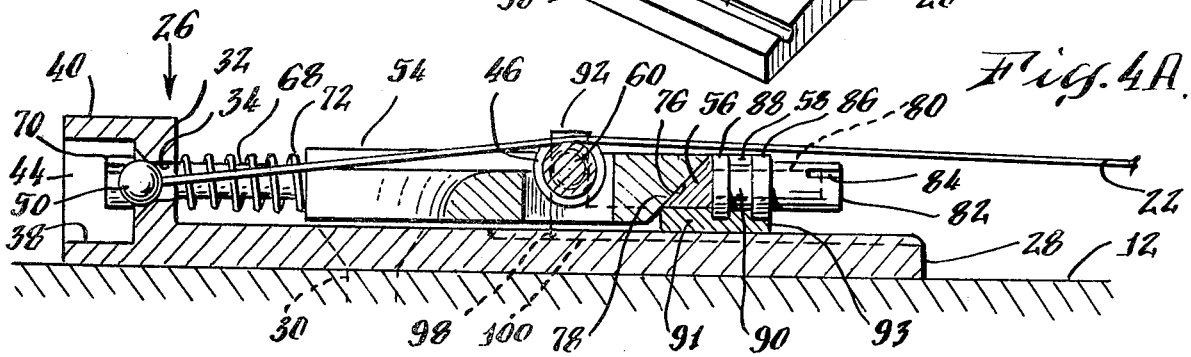
FIGS. 4A–4C are sectional views taken along the line 4—4 in FIG. 2 illustrating various string height adjustments for a preferred embodiment of the invention.

Referring to FIGS. 2, 3, and 4A–4C, it is seen that bridge 26 includes a bridge base 28 which is secured to guitar body 12 by screws 30 which pass through corresponding holes 31 formed in the bridge base. Referring both to FIG. 2 and FIG. 4A, it is seen that bridge base 28 has a right angle rear wall 32 with a plurality of first holes 34 and a plurality of second holes 36 formed therein. Extending from the rear of wall 32 is a base flange 38 and an overhang flange 40 which are interconnected by a plurality of webs 42. Wall 32, flanges 38 and 40 and webs 42 define four cavities 44, one for each of the strings 22. Each cavity 44 has an opening 34 and an opening 36 formed in its wall portion 32.

Each string 22 passes over a bridge saddle nut 46, having a string receiving groove 48 (see FIG. 3) formed in its periphery. Wall 32 serves as the instrument tailpiece, each string 22 passing through the corresponding hole 34 in wall 32 with ball 50 formed in the end of each string 22 preventing the string from being drawn back through hole 34.

As is best seen in FIG. 3, there is a bridge assembly 52 for each string 22, each bridge assembly consisting of a bridge saddle nut 46, a bridge saddle mounting assembly 54, a wedge member 56 and a guide member 58. A screw 60 has unthreaded ends which are friction fitted in a pair of grooves 62 formed in mounting member 54. Bridge saddle nut 46 has a hole 64 which is internally threaded to match the thread on screw 60, nut 46 being mounted for rotation on screw 60.

Mounting member 54 has an internally threaded opening 66 (see FIG. 2) formed in its rear wall. A screw 68 having a head 70 passes through each hole 36 and screws into the opening 66 of the corresponding mounting member 54. A spring 72 is mounted on each screw 68 between wall 32 and mounting member 54.

Lower wall 74 of mounting member 54 has a wedge shaped surface 76. Wedge member 56 has a wedge shaped surface 78 which is positioned under and substantially in physical contact with surface 76. A threaded shaft 80 projects from the rear surface of member 56 and has a nut 82 mounted thereon. Nut 82 has a screw head 84 formed at the far end thereof and a pair of collars 86 and 88 formed in its periphery, an annular groove 90 being formed in nut 82 between collars 86 and 88.

Guide member 58 has a pair of U-shaped side walls each of which has a forward leg 92 which mates with a corresponding groove 94 formed in the side of mounting member 54 to guide the mounting member as it moves up and down relative to guide member 58. The side walls are joined by a base section 91 which completely underlies wedge member 56 and a rear wall 93 having a semicircular opening 95 formed therein with a ridge 96 projecting therefrom. Ridge 96 fits in groove 90 of nut 82 to permit nut 82 to be rotated in member 58 but to otherwise prevent relative movement between these two elements. A runner 98 projects from the bottom of each side wall of member 58 which runner is adapted to fit into a corresponding groove 100 formed in the top surface of bridge base 28 to assure proper lateral positioning of each bridge assembly 52 and to prevent lateral movement of the bridge assemblies when strings are positioned thereon.

In operation, the spacing between adjacent strings 22 may be adjusted by loosening the machine head 20 for the string or strings whose position it is desired to change and then rotating bridge saddle nut 46 on screw 60 until the bridge saddle nut is at the desired lateral position. The machine head 20 is then tightened to return the string 22 to the desired tension.

Intonation adjustments may be made by loosening the string which is to have its intonation changed in the manner previously indicated and then turning the appropriate screw head 70, and thus the corresponding screw 68, to move the corresponding bridge assembly 52 either forward or backward. Spring 72 assures that the assembly remains in the selected position.

Figure 4B:
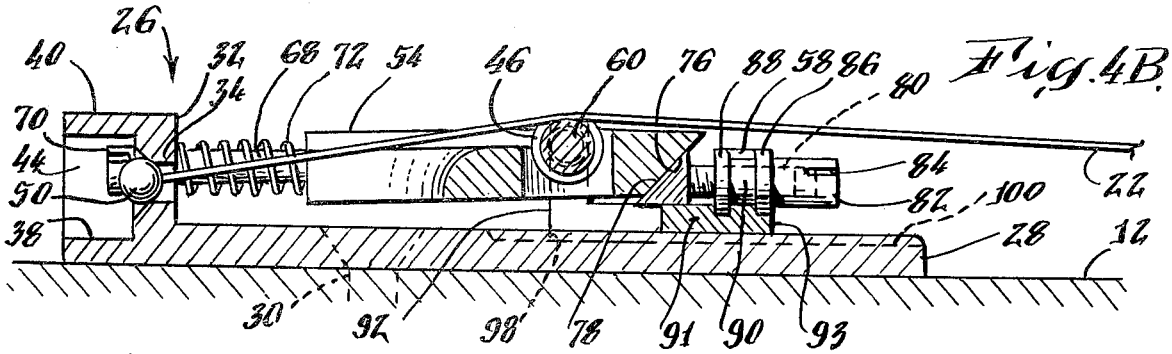
Figure 4C:
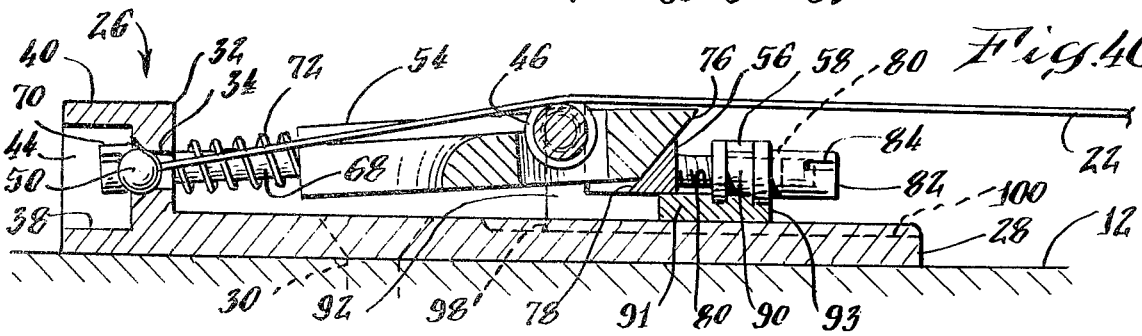

The height of each individual string 22 may be adjusted by rotating head 84 of the corresponding nut 82 to move the corresponding wedge member 56 either forward or backward. Referring to FIGS. 4A–4C, it is seen that with wedge member 56 in its rear-most position with its threaded projection 80 fully threaded in nut 82, mounting member 54, and thus string 22, is in its lower-most position. As threaded projection 80 is screwed out of nut 82, wedge member 56 is moved forward causing wedge surface 76 of mounting member 54 to ride up wedge surface 78 of the wedge member 56 as seen in FIG. 4B and thus causing mounting member 54 and bridge saddle nut 46 mounted thereon to be raised. This causes the string 22 to also be raised. FIG. 4C illustrates the positioning of these elements for the string in its fully raised position.

For preferred embodiments of the invention, bridge base 28, bridge saddle nut 46, mounting member 54, wedge member 56, and guide member 58 are all formed of metal. Further, the widths of all the members 54, 56, and 58 are all substantially equal. This provides a fairly solid relatively high mass metal-to-metal connection between the bridge saddle and the instrument body 12 resulting in good sustain characteristics for the instrument. In particular, the surfaces 76 and 78 provide a solid metal-to-metal connection between mounting member 54 and wedge member 56; the lower surface of wedge member 56 resting on base section 91 of guide member 58 provides a solid metal-to-metal connection between these two members; and the bottom of guide member 58, including base section 91, resting on bridge base 28 provides a solid metal-to-metal connection between these elements. Bridge base 28 rests directly on instrument body 12.

While for the preferred embodiment of the invention, a four-stringed bass guitar has been illustrated, it is apparent that the teachings of this invention would be equally applicable with a 6 or 12 string guitar or with other similar stringed musical instruments. Further, while a bridge having three levels of adjustment has been shown, it is apparent that the technique for raising or lowering string height taught in this invention is independent of the other two adjustments and that a bridge having only this adjustment or a bridge having this adjustment in combination with other forms of adjustment is within the contemplation of this invention. Further, while a particular means has been shown for wedging the bridge saddle mounting member up and down in the preferred embodiment of the invention, other means for accomplishing this wedging action are within the contemplation of the invention.

Thus, while the invention has been particularly shown and described above with reference to a preferred embodiment, the foregoing and other changes of form and detail may be made therein without departing from the spirit and scope of the invention.

What is claimed is:

1. A bridge for a stringed musical instrument comprising:

a bridge base:

a bridge saddle for each string of the instrument:

means for mounting each of said bridge saddles in a manner such that it may be independently moved up and down relative to said bridge base: and wedge shaped means adapted to coact with a surface of each of said means for mounting to control the height of the corresponding bridge saddle.

2. A bridge as claimed in claim 1 wherein said wedge means includes a wedge member mounted between each of said means for mounting and said bridge base, and means for independently moving each wedge member forward and backward relative to the corresponding means for mounting to cause said means for mounting, and thus said bridge saddle to be raised or lowered.

3. A bridge as claimed in claim 2 wherein a surface of each means for mounting which is in contact with the corresponding wedge member is wedge shaped.

4. A bridge as claimed in claim 3 wherein the width of each means for mounting and of the corresponding wedge member are substantially the same, wherein each wedge member has a wedge shaped surface in contact with the wedge shaped surface of the means for mounting, and wherein the widths of the wedge shaped surfaces are substantially the same as the widths of the respective means and members, whereby the area of contact between the means for mounting and the wedge member is maximized.

5. A bridge as claimed in claim 4 wherein said base, means for mounting and wedge member are all formed of metal; and wherein there is solid metal contact between the base of each wedge member and said bridge base, whereby solid metal contact is maintained between each means for mounting and said bridge base.

6. A bridge as claimed in claim 2 including, for each bridge saddle, a guide member mounted on said bridge base and fixed at one end so as to permit said means for mounting to move up or down relative to it but to permit relative motions in no other directions; and a nut fixedly mounted in the other end of said guide member and adapted for rotation therein;

said wedge member being mounted on said guide member and having a screw projecting from the rear thereof which screw coacts with said nut when said nut is rotated to move the wedge member forward or backward.

7. A bridge as claimed in claim 6 including means for independently moving each means for mounting, along with all the elements associated therewith including the bridge saddle, wedge member, guide member and nut, in the forward and backward directions, whereby the intonations of each string may be individually adjusted.

8. A bridge as claimed in claim 1 including means operative for independently moving each means for mounting, along with all the elements associated therewith including the bridge saddle and the wedge means, in the forward and backward directions, whereby the intonations of each string may be individually adjusted.

9. A bridge as claimed in claim 8 wherein each bridge saddle is a circular nut having a string receiving ridge formed in its periphery; and wherein said means for mounting includes a screw mounted perpendicular to the corresponding string, said bridge saddle nut being mounted to rotate on the screw, whereby the spacing between strings may be individually adjusted.

10. A bridge as claimed in claim 1 wherein each bridge saddle is a circular nut having a string receiving ridge formed in its periphery; and wherein said means for mounting includes a screw mounted perpendicular to the corresponding string, said bridge saddle nut being mounted to rotate on the screw, whereby the spacing between strings may be individually adjusted.

11. A bridge for a stringed musical instrument comprising:

a bridge base; and a bridge assembly for each string of the instrument, each of said bridge assemblies including a bridge saddle, means for mounting said bridge saddle in a manner such that it may be pivoted up or down relative to said bridge base, a wedge member positioned between said means for mounting and said bridge base, and means for moving said wedge member relative to said means for mounting in a manner so as to raise or lower said means for mounting, whereby the height of each bridge saddle may be independently controlled.

12. A bridge as claimed in claim 11 including means for independently moving each bridge assembly forward and backward whereby the intonation of each string may be independently adjusted.

* * * * *